US010857819B2

(12) United States Patent
Hattori et al.

(10) Patent No.: US 10,857,819 B2
(45) Date of Patent: Dec. 8, 2020

(54) PRINTING APPARATUS, METHOD OF CONTROLLING PRINTING APPARATUS, AND STORAGE MEDIUM

(71) Applicant: CANON KABUSHIKI KAISHA, Tokyo (JP)

(72) Inventors: Yuna Hattori, Kawasaki (JP); Tomofumi Nishida, Kawasaki (JP); Takaaki Ishida, Kawasaki (JP); Masaaki Matsuura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/363,411

(22) Filed: Mar. 25, 2019

(65) Prior Publication Data

US 2019/0299675 A1 Oct. 3, 2019

(30) Foreign Application Priority Data

Mar. 29, 2018 (JP) ..... 2018-065555

(51) Int. Cl.

| | |
|---|---|
| ***B41J 13/00*** | (2006.01) |
| ***B41J 11/00*** | (2006.01) |
| ***B41J 23/02*** | (2006.01) |
| ***B41J 13/26*** | (2006.01) |

(52) U.S. Cl.

CPC ..... *B41J 13/0009* (2013.01); *B41J 11/0095* (2013.01); *B41J 13/26* (2013.01); *B41J 23/025* (2013.01)

(58) Field of Classification Search

CPC ..... B41J 23/26; B41J 13/0036

See application file for complete search history.

(56) References Cited

U.S. PATENT DOCUMENTS

| | | | |
|---|---|---|---|
| 9,370,946 | B2 | 6/2016 | Nishida et al. |
| 9,388,010 | B2 | 7/2016 | Kunihiro et al. |
| 9,586,780 | B2 | 3/2017 | Nishida et al. |

(Continued)

FOREIGN PATENT DOCUMENTS

| | | | |
|---|---|---|---|
| JP | 2013-230889 | A | 11/2013 |

OTHER PUBLICATIONS

U.S. Appl. No. 16/220,871, Masaaki Matsuura, Seiji Ogasawara, Takaaki Ishida, Masakazu Tsukuda, Shuichi Tokuda, Kazuki Matsuo, filed Dec. 14, 2018.

(Continued)

*Primary Examiner* — Shelby L Fidler

(74) *Attorney, Agent, or Firm* — Venable LLP

(57) ABSTRACT

A printing apparatus can be downsized while degradation in the print quality can be suppressed. To perform skew correction on a second print medium on which printing is to be performed subsequent to a first print medium, a first conveying unit disposed upstream of the printing position where the printing unit performs printing on the print medium is stopped. Then, driving and stopping of third conveying unit disposed downstream of a second conveying unit is controlled, depending on whether the first print medium after printing has already passed by the second conveying unit when the first conveying unit is stopped, the second conveying unit being driven by the same driving source as that for the first conveying unit and being disposed downstream of the printing position.

20 Claims, 11 Drawing Sheets

(56) References Cited

U.S. PATENT DOCUMENTS

| | | | | |
|---|---|---|---|---|
| 2003/0030712 | A1* | 2/2003 | Kawaguchi | B41J 11/42 347/104 |
| 2006/0066651 | A1* | 3/2006 | Linville | B41J 13/0027 347/9 |
| 2007/0076036 | A1* | 4/2007 | Koga | B41J 19/94 347/16 |
| 2015/0022577 | A1* | 1/2015 | Hakamata | B41J 13/0018 347/16 |
| 2015/0174928 | A1* | 6/2015 | Tokisawa | B41J 13/0018 347/16 |
| 2015/0256694 | A1 | 9/2015 | Suzuki et al. | |
| 2017/0129726 | A1 | 5/2017 | Nishida et al. | |
| 2018/0281479 | A1* | 10/2018 | Ito | B41J 3/60 |

OTHER PUBLICATIONS

U.S. Appl. No. 16/259,191, Shuichi Tokuda, Seiji Ogasawara, Takaaki Ishida, Masakazu Tsukuda, Masaaki Matsuura, Kazuki Matsuo, Tomofumi Nishida, Yuna Hattori, filed Jan. 28, 2019.

U.S. Appl. No. 16/270,950, Kazuki Matsuo, Seiji Ogasawara, Takaaki Ishida, Shuichi Tokuda, Masakazu Tsukuda, Masaaki Matsuura, filed Feb. 8, 2019.

* cited by examiner

PRINTING APPARATUS, METHOD OF CONTROLLING PRINTING APPARATUS, AND STORAGE MEDIUM

BACKGROUND OF THE INVENTION

Field of the Invention

The present invention relates to printing apparatuses to perform printing on sheet-shaped print media that are conveyed, methods of controlling printing apparatuses, and storage media.

Description of the Related Art

Japanese Patent Laid-Open No. 2013-230889 discloses a technique in which multiple roller pairs located upstream of a first conveying roller pair used for a skew correction process are driven by a common motor to achieve downsizing and cost reduction of the apparatus. Note that in the technique disclosed in Japanese Patent Laid-Open No. 2013-230889, the area where the technique of making a common motor drive multiple rollers is applicable is limited to positions away from the image forming part (printing part).

However, if the technique disclosed in Japanese Patent Laid-Open No. 2013-230889 is applied, to achieve further downsizing, to a first conveying roller pair and a roller pair located downstream thereof, the area where the first conveying roller pair and downstream roller pair driven by a common motor are located would include the printing position for the print medium. Thus, in the case of continuous printing on print media, when the first conveying roller pair is stopped to perform skew correction on a succeeding print medium, a preceding print medium being conveyed by the downstream roller pair may be in the middle of printing. In this case, it is necessary to suspend printing on the print medium when the first conveying roller pair is stopped, and this may cause degradation in the print quality.

SUMMARY OF THE INVENTION

The present invention has been made in view of the above problem, and an object thereof is to provide a printing apparatus that can be downsized while degradation in the print quality is suppressed, a method of controlling a printing apparatus, and a storage medium.

In a first aspect of the present invention, there is provided a printing apparatus comprising:

a printing unit configured to perform printing on a print medium;

a first conveying unit configured to convey the print medium to a position facing the printing unit and stop to perform skew correction on the print medium;

a second conveying unit configured to be disposed downstream of the first conveying unit in a conveyance direction of the print medium and convey the print medium;

a third conveying unit configured to be disposed downstream of the second conveying unit in the conveyance direction and convey the print medium;

a first drive unit configured to drive the first conveying unit and the second conveying unit;

a second drive unit configured to drive the third conveying unit; and a drive control unit configured to perform control such that when skew correction is performed on a second print medium on which printing is to be performed subsequent to a first print medium, if the first print medium is not being conveyed by the second conveying unit, the second drive unit continues to be driven and the first drive unit is stopped, and if the first print medium is being conveyed by the second conveying unit, the first drive unit and the second drive unit are stopped.

In a second aspect of the present invention, there is provided a method of controlling a printing apparatus including:

a printing unit configured to perform printing on a print medium;

a first conveying unit configured to convey the print medium to a position facing the printing unit and stop to perform skew correction on the print medium;

a second conveying unit configured to be disposed downstream of the first conveying unit in a conveyance direction of the print medium and convey the print medium;

a third conveying unit configured to be disposed downstream of the second conveying unit in the conveyance direction and convey the print medium;

a first drive unit configured to drive the first conveying unit and the second conveying unit; and a second drive unit configured to drive the third conveying unit, the method comprising:

a drive controlling step of performing control such that when skew correction is performed on a second print medium on which printing is to be performed subsequent to a first print medium, if the first print medium is not being conveyed by the second conveying unit, the second drive unit continues to be driven and the first drive unit is stopped, and if the first print medium is being conveyed by the second conveying unit, the first drive unit and the second drive unit are stopped.

In a third aspect of the present invention, there is provided a non-transitory computer readable storage medium storing a program for causing a computer to perform a method of controlling a printing apparatus including:

a printing unit configured to perform printing on a print medium;

a first conveying unit configured to convey the print medium to a position facing the printing unit and stop to perform skew correction on the print medium;

a second conveying unit configured to be disposed downstream of the first conveying unit in a conveyance direction of the print medium and be driven together with the first conveying unit by a first drive unit; and a third conveying unit configured to be disposed downstream of the second conveying unit in the conveyance direction and be driven by a second drive unit different from the first drive unit, the method comprising:

a drive controlling step of causing a computer included in the printing apparatus to perform control such that when skew correction is performed on a second print medium on which printing is to be performed subsequent to a first print medium, if the first print medium is not being conveyed by the second conveying unit, the second drive unit continues to be driven and the first drive unit is stopped, and if the first print medium is being conveyed by the second conveying unit, the second drive unit and the first drive unit are stopped.

The present invention achieves downsizing without causing degradation in the print quality.

Further features of the present invention will become apparent from the following description of exemplary embodiments with reference to the attached drawings.

BRIEF DESCRIPTION OF THE DRAWINGS

FIG. 10 is a diagram showing the relationship between FIG. 10A and FIG. 10B.

DESCRIPTION OF THE EMBODIMENTS

Figure 1:
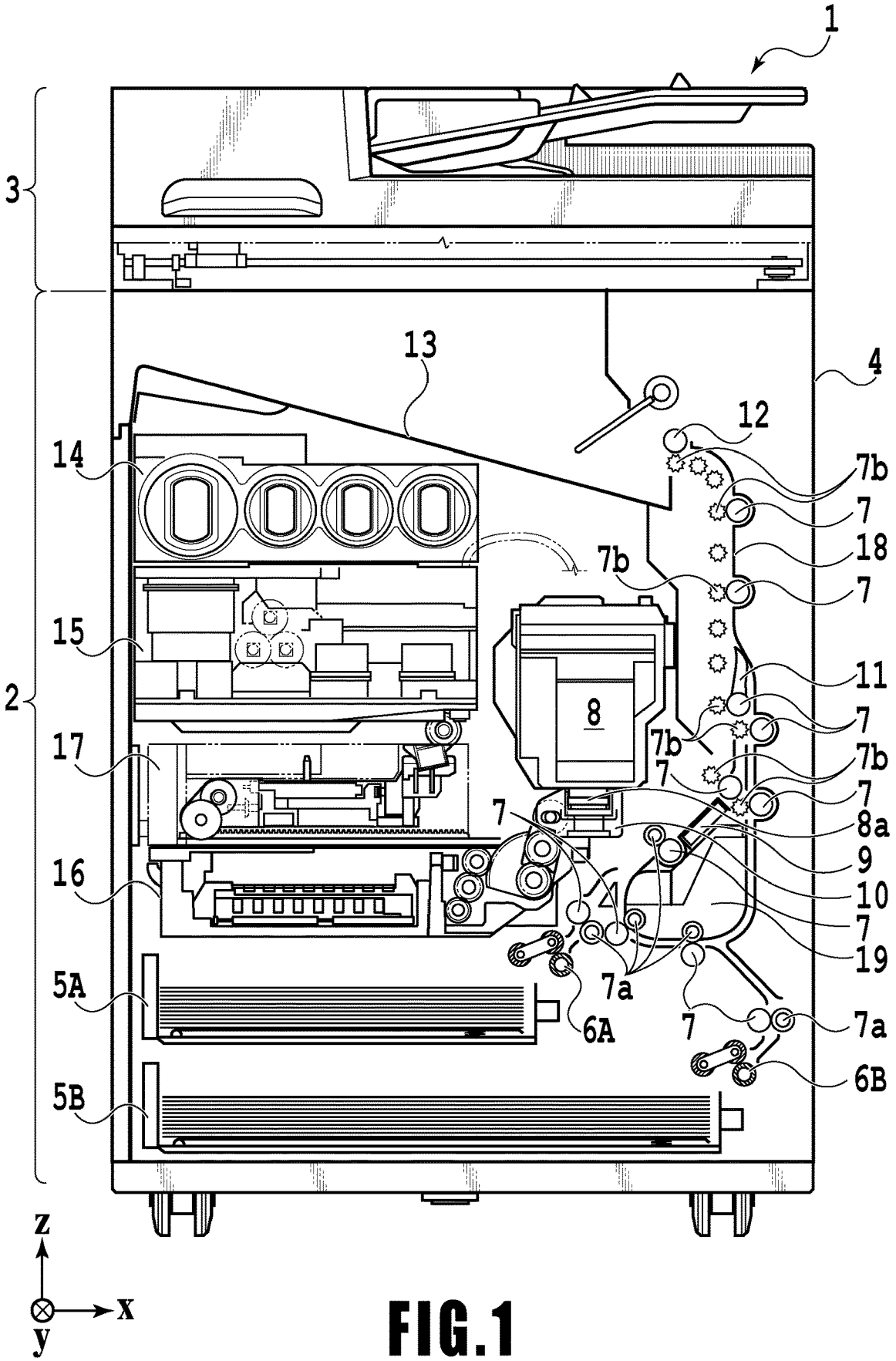
FIG. 1 is a view of a printing apparatus in a standby state.

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing printing medium (cut sheets) S are detachably provided at the bottom of a casing 4 in the vertical direction. Relatively small printing media of up to A4 size are stacked and housed in the first cassette 5A and relatively large printing media of up to A3 size are stacked and housed in the second cassette 5B. A first feeding unit 6A for feeding housed printing media one by one is provided near the first cassette 5A. Similarly, a second feeding unit 6B is provided near the second cassette 5B. In print operation, a print medium S is selectively fed from either one of the cassettes.

Conveying rollers 7 (a main conveying roller 70 is included.), a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8.

The printing apparatus 1 has multiple motors for driving the above drive rollers, and each drive roller is connected to one of the motors. The relationship between the motors and the drive roller will be described later in detail.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print media S is conveyed in duplex print operation. A discharging tray 13 is a tray for stacking and housing printing medium S that were subjected to print operation and discharged by the discharging roller 12.

The print head 8 (printing unit) of the present embodiment is a full line type color inkjet print head. In the print head 8, a plurality of ejection openings configured to eject ink based on print data are arrayed in the y-direction in FIG. 1 so as to correspond to the width of a print medium S. That is, the print head is configured to eject inks of a plurality of colors. When the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports a print medium S being subjected to print operation by the print head 8 from the back side. The movement of the print head 8 from the standby position to a print operation position will be described later in detail. The print head 8 is provided with a temperature sensor (not illustrated) for controlling the temperature of the print head 8. The detection results by the temperature sensor are inputted to the print controller 202.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8. The maintenance operation will be described later in detail.

Figure 2:
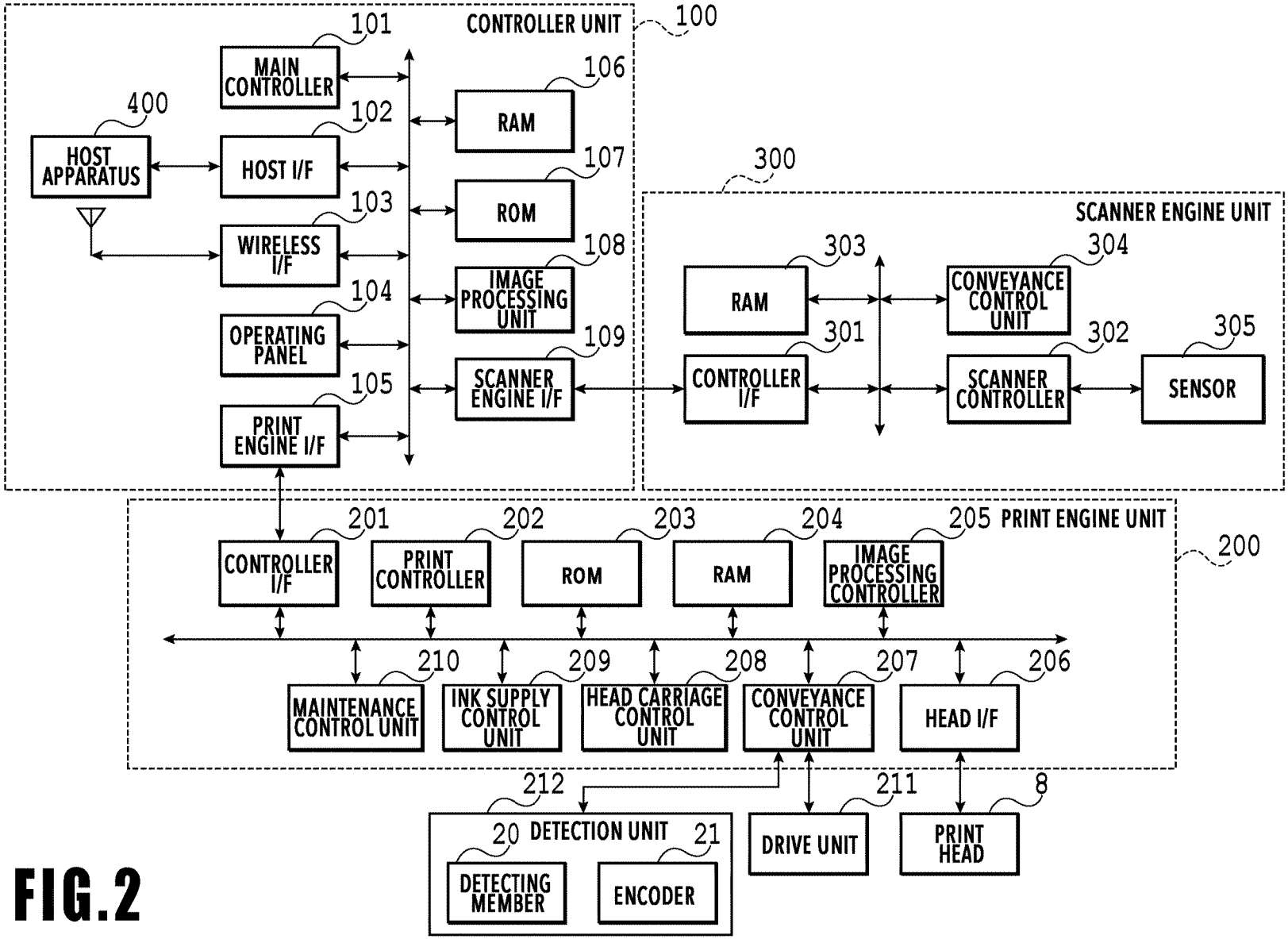
FIG. 2 is a diagram of a control configuration of the printing apparatus.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to perform input and output for the printing apparatus 1. A user can give an instruction to perform an operation such as copying or scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 controls driving of a drive unit 211 (described later) via a head I/F 206 to perform print operation based on the print data by the print head 8. At this time, the print controller 202 controls driving of the drive unit 211 via a conveyance control unit 207 to convey the print medium S, using the feeding units 6A and 6B, conveying rollers 7, discharging roller 12, and flapper 11 illustrated in FIG. 1. In other words, the print controller 202 and the conveyance control unit 207 function as the drive control unit to control driving of the drive unit 211 for conveying the print medium S.

The conveyance control unit 207 is connected to a detection unit 212 that detects the conveying state of the print medium S and the drive unit 211 that drives the multiple drive rollers. For example, the conveyance control unit 207 can control conveyance of the print medium S using the drive unit 211, for example, based on the detection results obtained from the detection unit 212. The detection unit 212 includes detection members 20 that detect the presence of the print medium S and encoders 21 that detect the amount of rotation of the drive rollers. The printing process is performed, in the course of the print medium S being conveyed by the conveyance control unit 207 controlling the drive unit 211, by the print head 8 performing print operation according to the instruction from the print controller 202 in conjunction with the conveyance operation of the print medium S.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
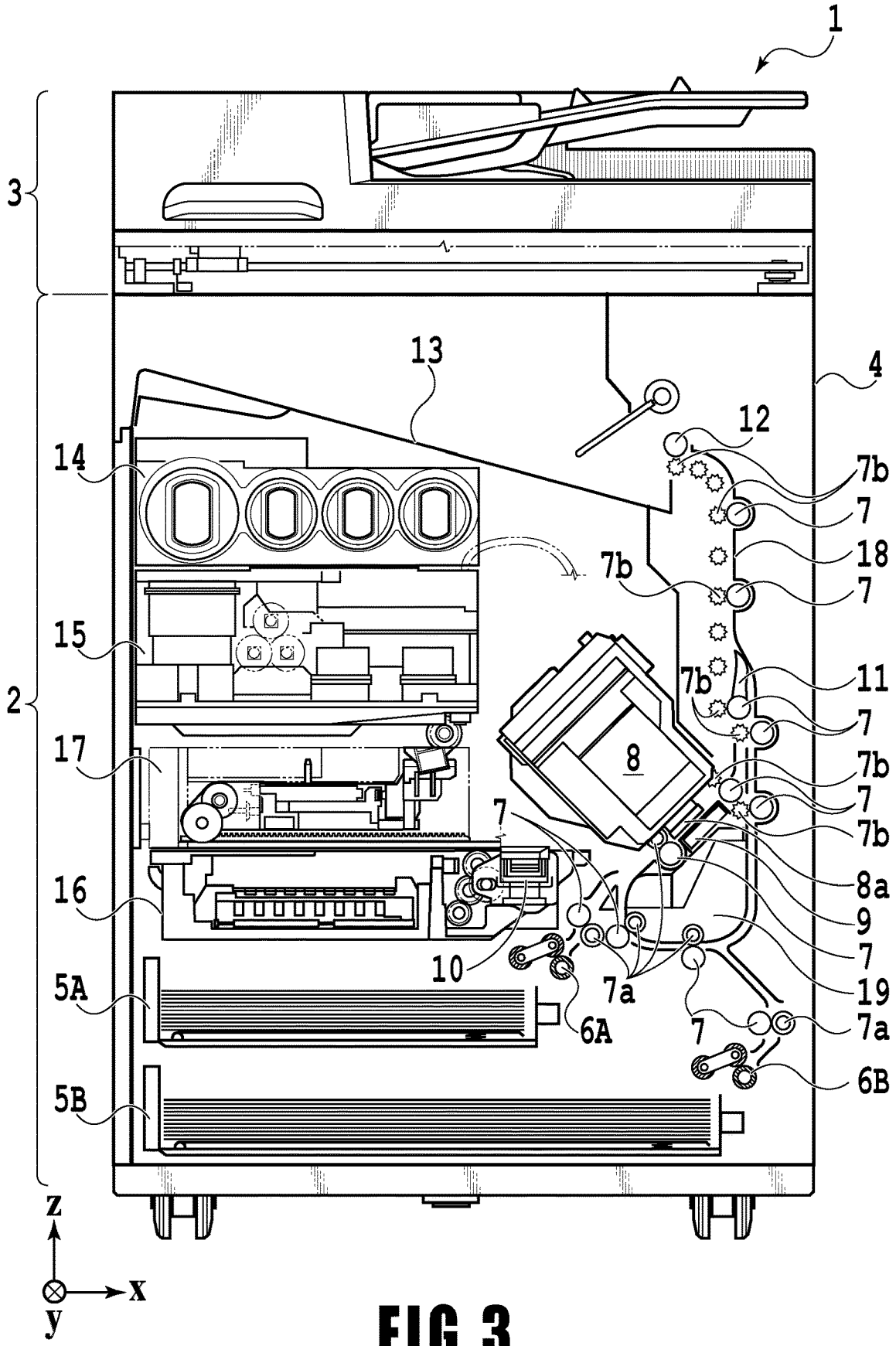
FIG. 3 is a view of the printing apparatus in a print state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in the print operation position is also inclined about 45° with respect to the horizontal plane so as to keep a constant distance from the platen 9.

In the case of moving the print head 8 from the standby position shown in FIG. 1 to the print operation position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the above procedure to move the print head 8 from the print operation position to the standby position.

Next, a conveying path of a print medium S in the print unit 2 will be described. When a print command is input, the print controller 202 first uses the maintenance control unit 210 and the head carriage control unit 208 to move the print head 8 to the print operation position shown in FIG. 3. The print controller 202 then uses the conveyance control unit 207 to drive either the first feeding unit 6A or the second feeding unit 6B in accordance with the print command and feed a print medium S.

Figure 4C:
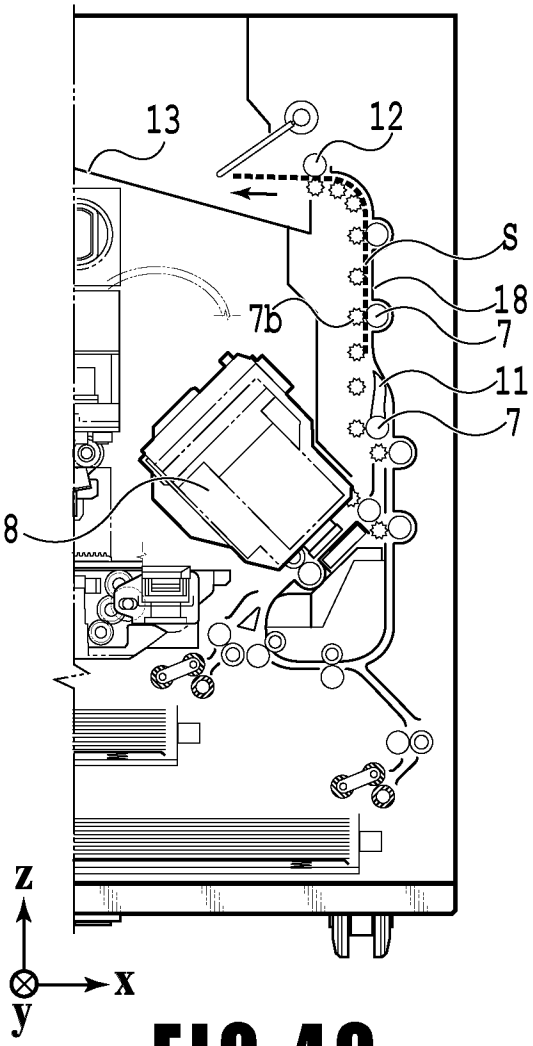
FIG. 4A, FIG. 4B, and FIG. 4C are views of a conveying path of a print medium fed from a first cassette.
Figure 4B:
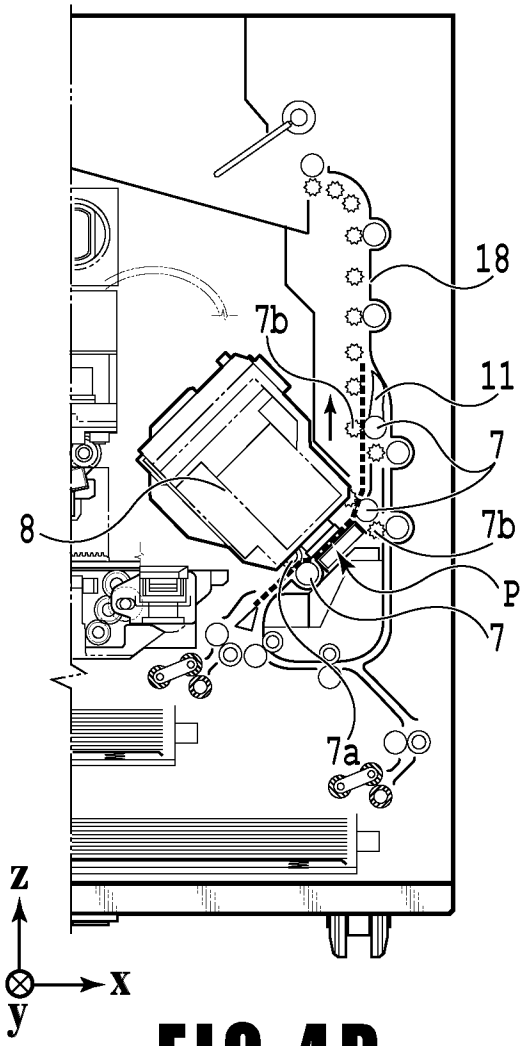
Figure 4A:
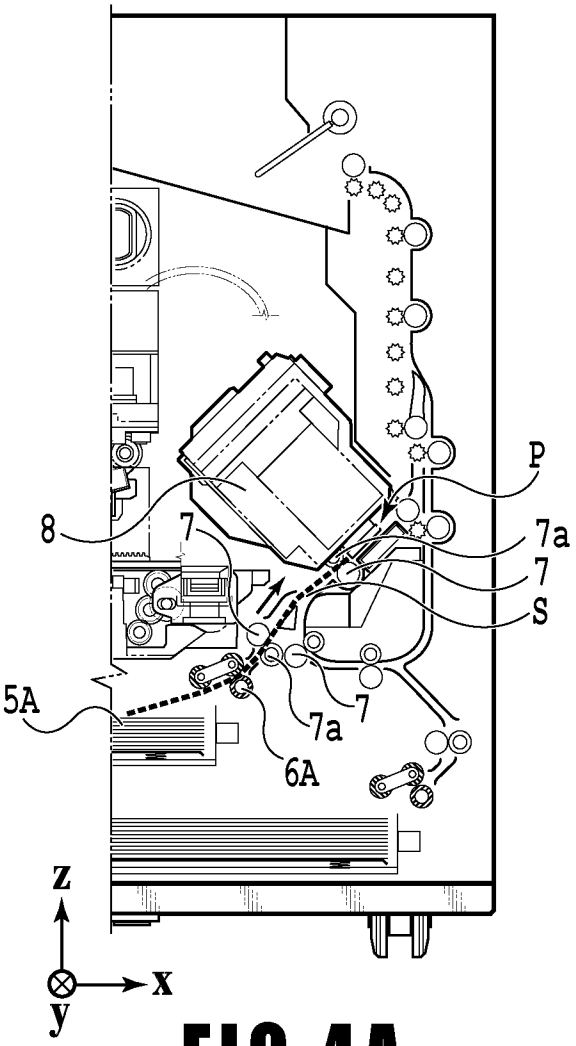

FIGS. 4A to 4C are diagrams showing a conveying path in the case of feeding an A4 size print medium S from the first cassette 5A. A print medium S at the top of a stack of printing media in the first cassette 5A is separated from the rest of the stack by the first feeding unit 6A and conveyed toward a print area P between the platen 9 and the print head 8 while being nipped between the conveying rollers 7 and the pinch rollers 7*a*. FIG. 4A shows a conveying state where the front end of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In the print area P, a plurality of ejection openings provided in the print head 8 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveying rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the front end of the print medium S has passed through the print area P and the print medium S is being conveyed vertically upward. The conveying rollers 7 and the spurs 7*b* change the direction of movement of the print medium S from the direction inclined about 45° with respect to the horizontal direction in the print area P to the vertically upward direction.

After being conveyed vertically upward, the print medium S is discharged into the discharging tray 13 by the discharging roller 12 and the spurs 7*b*. FIG. 4C shows a state where the front end of the print medium S has passed through the discharging roller 12 and the print medium S is being discharged into the discharging tray 13. The discharged print medium S is held in the discharging tray 13 with the side on which an image was printed by the print head 8 down.

Figure 5C:
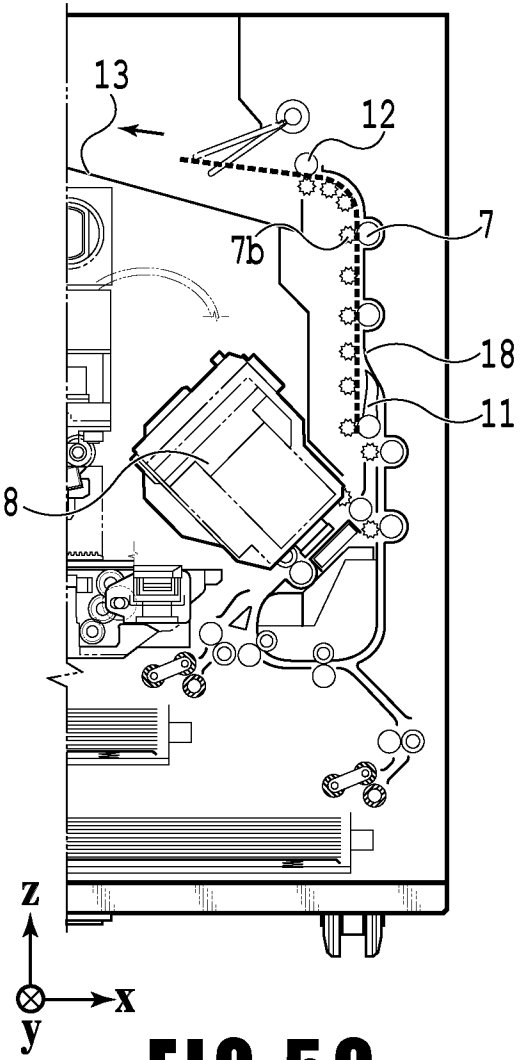
FIG. 5A, FIG. 5B, and FIG. 5C are views of a conveying path of a print medium fed from a second cassette.
Figure 5B:
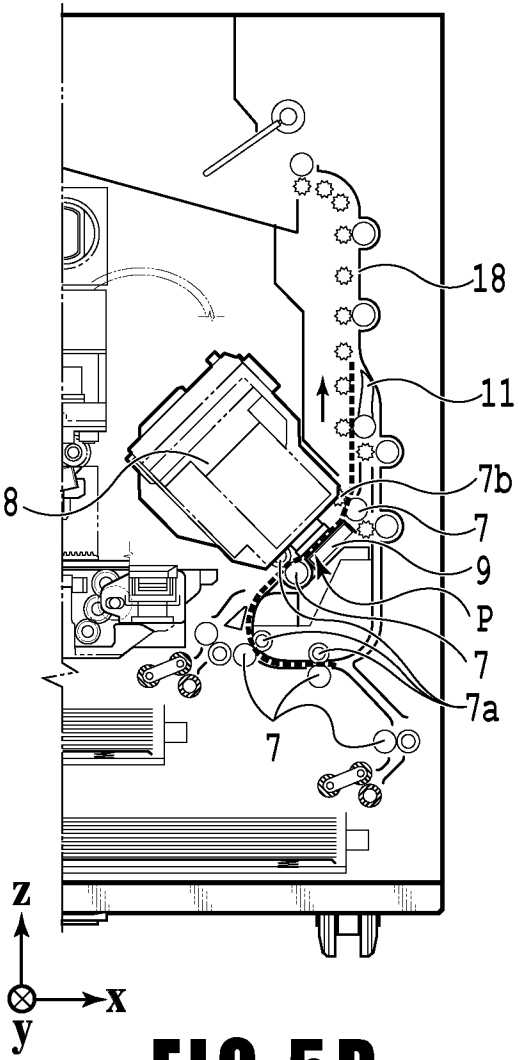
Figure 5A:
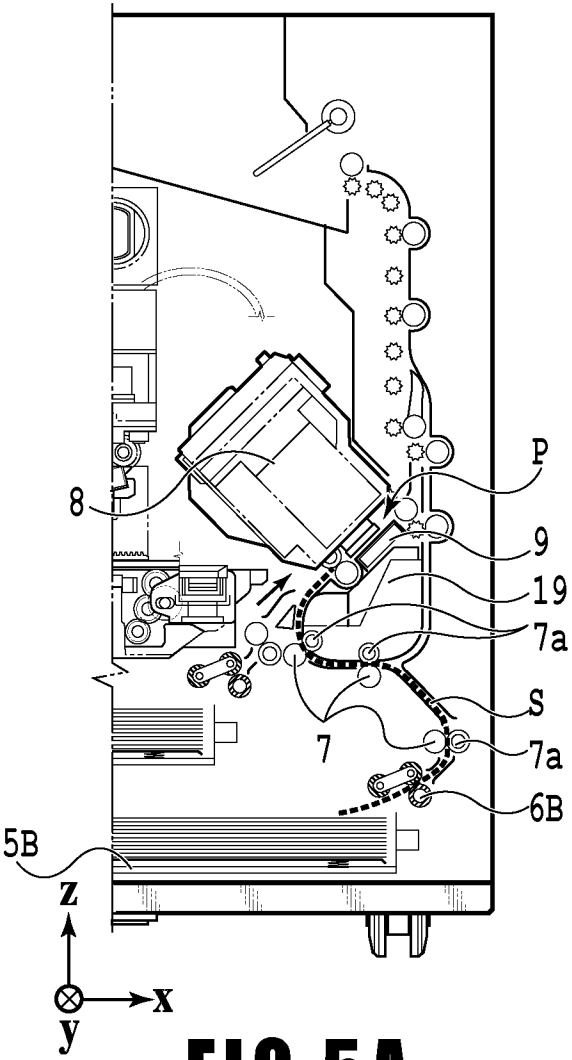

FIGS. 5A to 5C are diagrams showing a conveying path in the case of feeding an A3 size print medium S from the second cassette 5B. A print medium S at the top of a stack of printing medium in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the front end of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The rest of the conveying path is the same as that in the case of the A4 size print medium S shown in FIGS. 4B and 4C. FIG. 5B shows a state where the front end of the print medium S has passed through the print area P and the print medium S is being conveyed vertically upward. FIG. 5C shows a state where the front end of the print medium S has passed through the discharging roller 12 and the print medium S is being discharged into the discharging tray 13.

FIGS. 6A to 6D show a conveying path in the case of performing print operation (duplex printing) for the back side (second side) of an A4 size print medium S. In the case of duplex printing, print operation is first performed for the first side (front side) and then performed for the second side (back side). A conveying procedure during print operation for the first side is the same as that shown in FIGS. 4A to 4C and therefore description will be omitted. A conveying procedure subsequent to FIG. 4C will be described below.

Figure 6D:
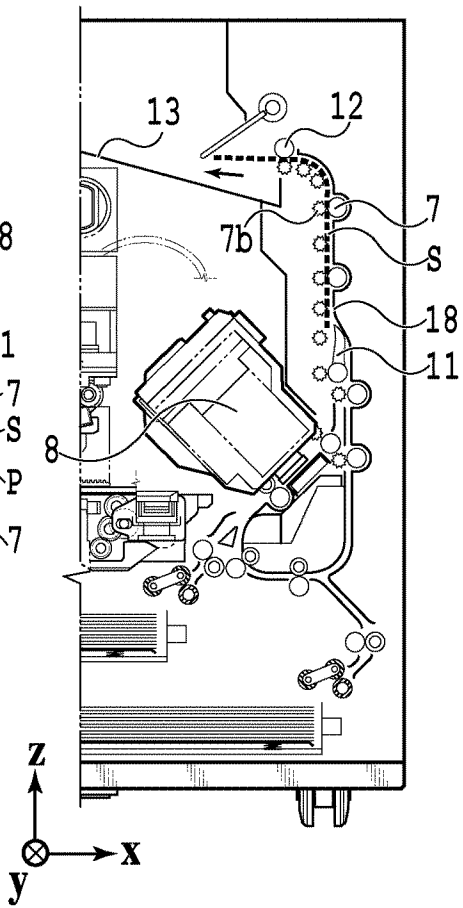
FIG. 6A, FIG. 6B, FIG. 6C, and FIG. 6D are views of a conveying path used in a case of performing a print operation on the back surface of a print medium.
Figure 6C:
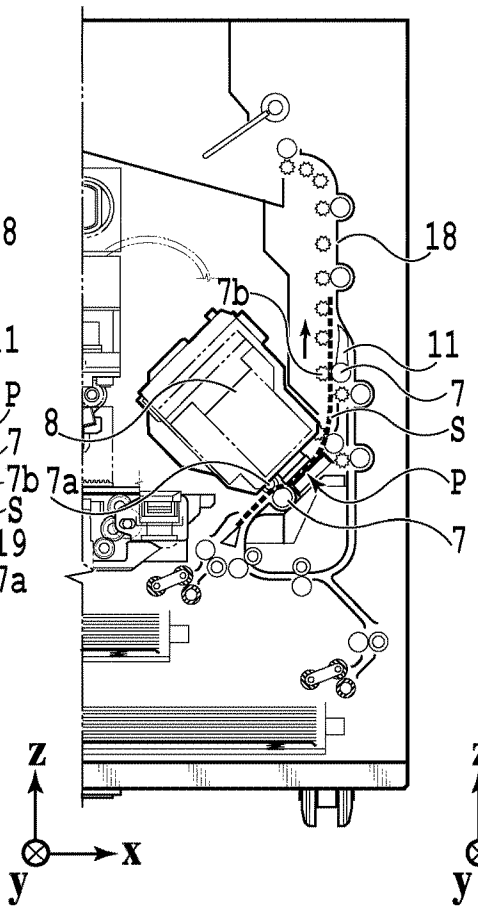
Figure 6B:
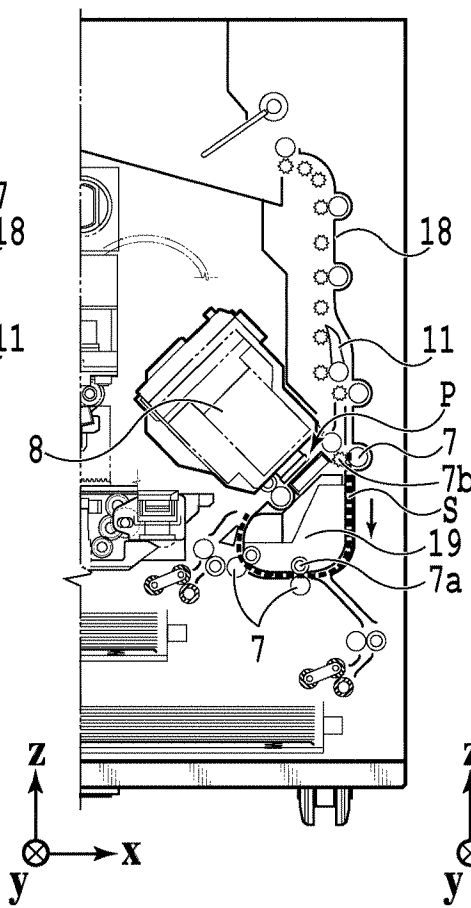
Figure 6A:
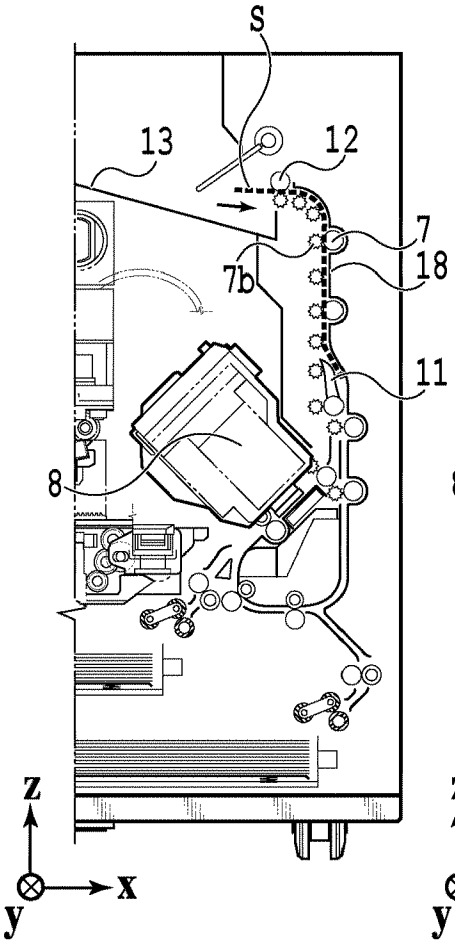

After the print head 8 finishes print operation for the first side and the back end of the print medium S passes by the flapper 11, the print controller 202 turns the conveying rollers 7 backward to convey the print medium S into the printing apparatus 1. At this time, since the flapper 11 is controlled by an actuator (not shown) such that the tip of the flapper 11 is inclined to the left, the front end of the print medium S (corresponding to the back end during the print operation for the first side) passes on the right of the flapper 11 and is conveyed vertically downward. FIG. 6A shows a state where the front end of the print medium S (corresponding to the back end during the print operation for the first side) is passing on the right of the flapper 11.

Then, the print medium S is conveyed along the curved outer surface of the inner guide 19 and then conveyed again to the print area P between the print head 8 and the platen 9. At this time, the second side of the print medium S faces the ejection opening surface 8*a* of the print head 8. FIG. 6B shows a conveying state where the front end of the print medium S is about to reach the print area P for print operation for the second side.

The rest of the conveying path is the same as that in the case of the print operation for the first side shown in FIGS. 4B and 4C. FIG. 6C shows a state where the front end of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the front end of the print medium S has passed through the discharging roller 12 and the print medium S is being discharged into the discharging tray 13.

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 7:
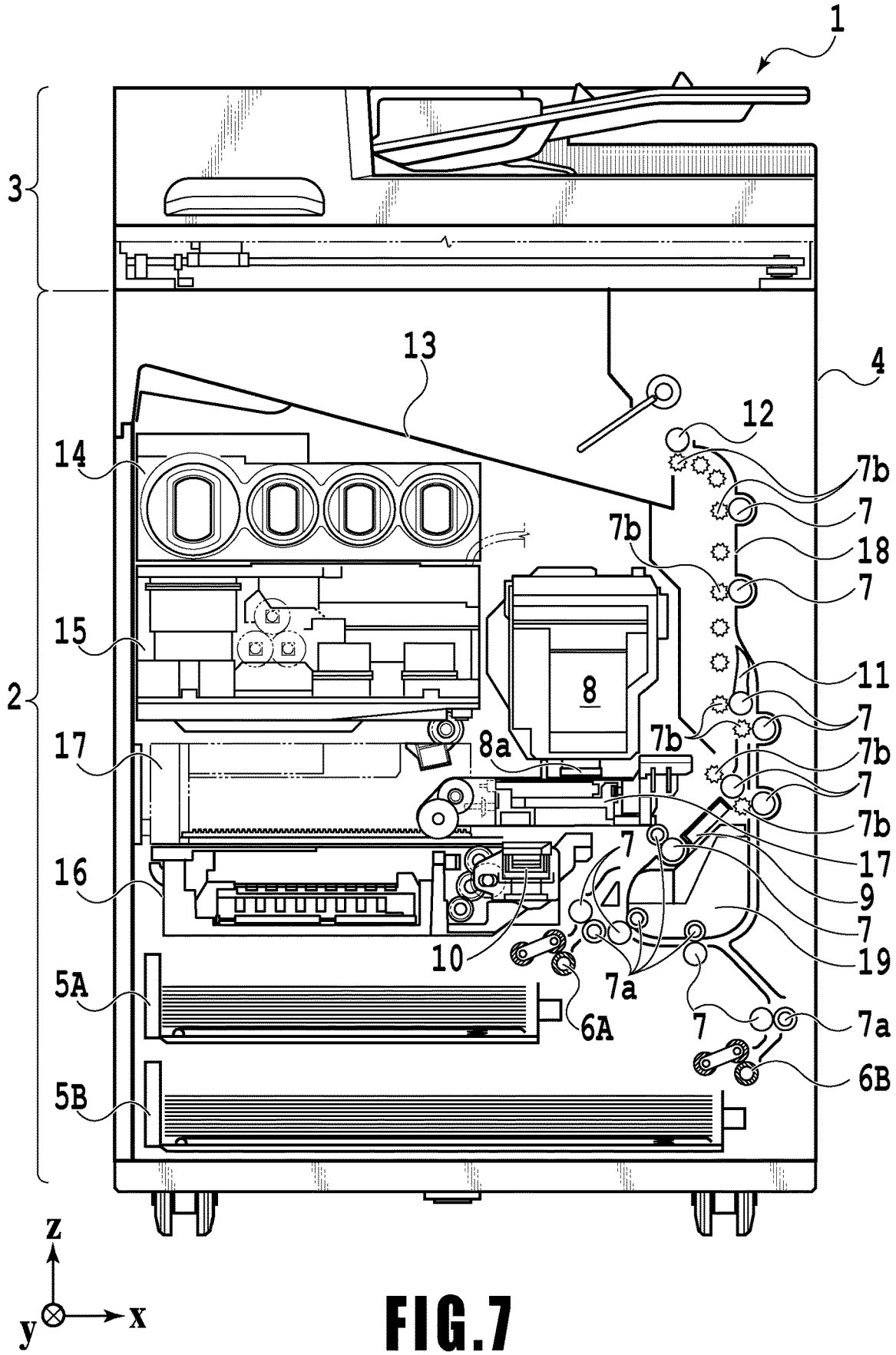
FIG. 7 is a view of the printing apparatus in a maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where maintenance operation can be performed.

On the other hand, in the case of moving the print head 8 from the print operation position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed.

Figure 8:
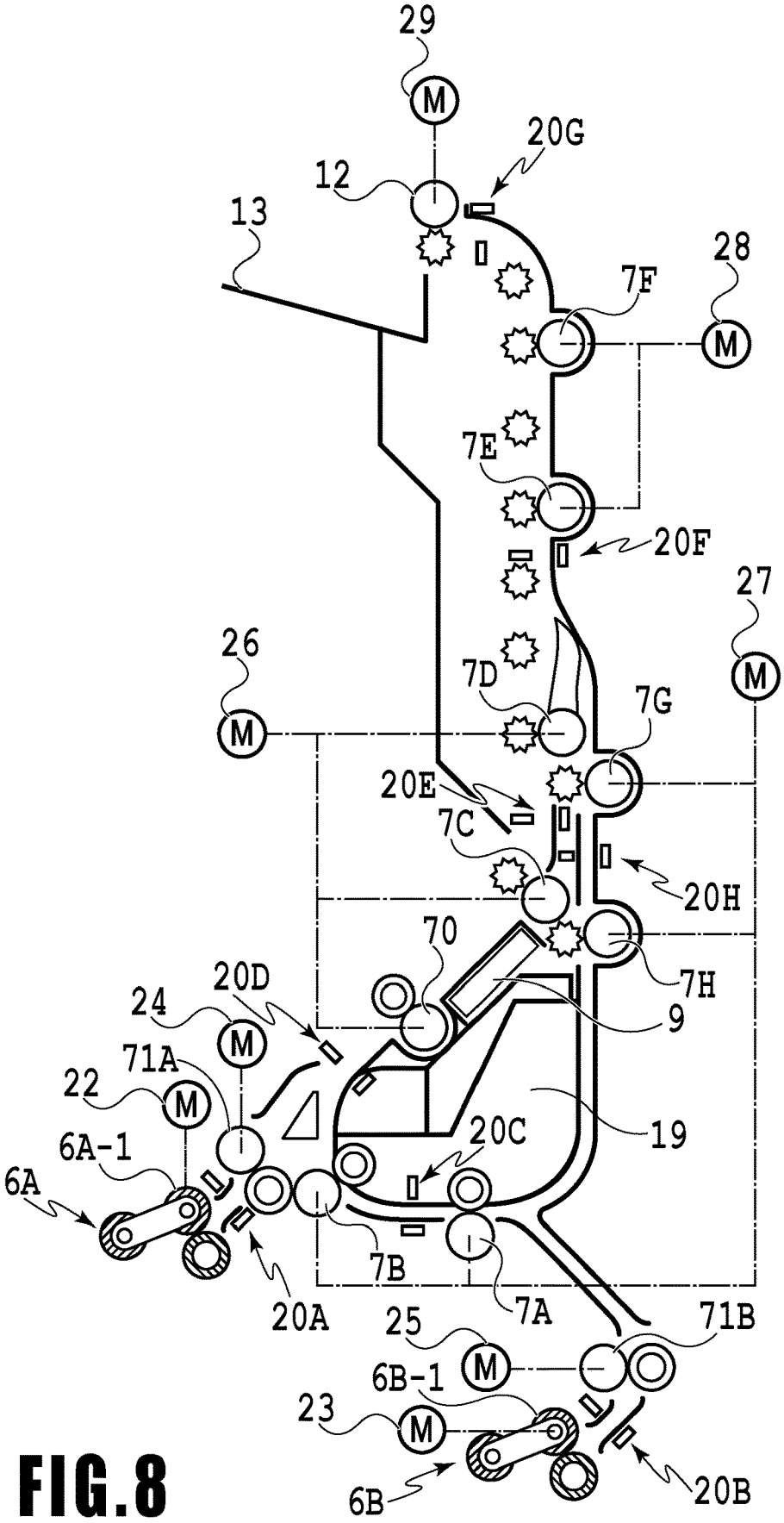
FIG. 8 is a diagram illustrating the relationship between drive rollers and motors.

FIG. 8 is a diagram illustrating the correspondence relationship between the multiple motors and drive rollers in the printing apparatus 1. A first feeding motor 22 (third drive unit) drives a first feeding roller 6A-1 (feeding unit) of the first feeding unit 6A for feeding the print medium S from the first cassette 5A. A second feeding motor 23 drives a second feeding roller 6B-1 of the second feeding unit 6B for feeding the print medium S from the second cassette 5B. A first conveying motor 24 drives a first intermediate roller 71A which is the first member to convey the print medium S fed by the first feeding unit 6A. A second conveying motor 25 drives a second intermediate roller 71B which is the first member to convey the print medium S fed by the second feeding unit 6B.

A main conveying motor 26 drives a main conveying roller 70 which is disposed upstream of the platen 9 and mainly conveys the print medium S during printing. The main conveying motor 26 also drives two conveying rollers 7C and 7D which are disposed downstream of the platen 9 and convey further downstream the print medium S conveyed by the main conveying roller 70.

A third conveying motor 27 drives two conveying rollers 7G and 7H which convey downward the print medium S on the first side of which printing has been performed. The third conveying motor 27 also drives two conveying rollers 7A and 7B which are disposed along the inner guide 19 and convey toward the print head 8 the print medium S conveyed by the second intermediate roller 71B or the print medium S on the first side of which printing has been performed and which was reversed.

A fourth conveying motor 28 drives two conveying rollers 7E and 7F which convey upward or downward the print medium S on which print operation has been performed. A discharging motor 29 drives the discharging roller 12 which discharges the print medium S on which printing has been performed to the discharging tray 13. In this way, each of the two feeding motors 22 and 23, five conveying motors 24 to 28, and discharging motor 29 is associated with one or more drive rollers.

Meanwhile, at eight places along the conveying path are disposed the detection members 20 (detection members 20A to 20H) for detecting the presence of the print medium S. Each detection member 20 includes a sensor and a mirror disposed on both sides of the conveying path. The sensor having a light emitting portion and a light receiving portion is disposed on one side of the conveying path; the mirror is disposed at a position on the other side of the conveying path and facing the sensor. The light emitted from the light emitting portion of the sensor is reflected by the mirror, and the presence of a print medium S, in other words, whether the leading edge or the trailing edge has passed is determined based on whether the light receiving portion detects the reflected light.

The conveyance control unit 207 drives the feeding motors 22 and 23, the conveying motors 24 to 28, and the discharging motor 29 individually to control the conveyance as the entire apparatus, based on the detection results from the multiple detection members 20 and the output values of the encoders each of which detects the amount of rotation of the corresponding drive roller.

The detection members 20A to 20H along with the encoders 21 make up the detection unit 212. Note that the number of detection members disposed along the conveying path is not limited to eight. Each encoder 21 (not illustrated in FIG. 8), provided for a drive roller associated with each detection member 20 in the conveying path, detects the amount of rotation of the drive roller. Each encoder 21 is, for example, associated with the detection member 20 located immediately downstream of a disposed drive roller.

Meanwhile, in the printing apparatus 1, skew correction of the print medium S is performed by bringing the leading edge of the print medium S into contact with the nip portion between the main conveying roller 70 and the pinch roller 7*a* which are not in operation. Note that the main conveying roller 70 is located upstream, in the conveying path, of the printing position at which printing is performed on the print medium S by the print head 8. As described above, the main conveying roller 70 is driven by the common conveying motor 26 which also drives the conveying rollers 7C and 7D located downstream of the main conveying roller 70. Note that in the following description, "the nip portion between the main conveying roller 70 and the pinch roller 7*a*" is referred to as "the nip portion of the main conveying roller 70" as appropriate.

Figure 9A:
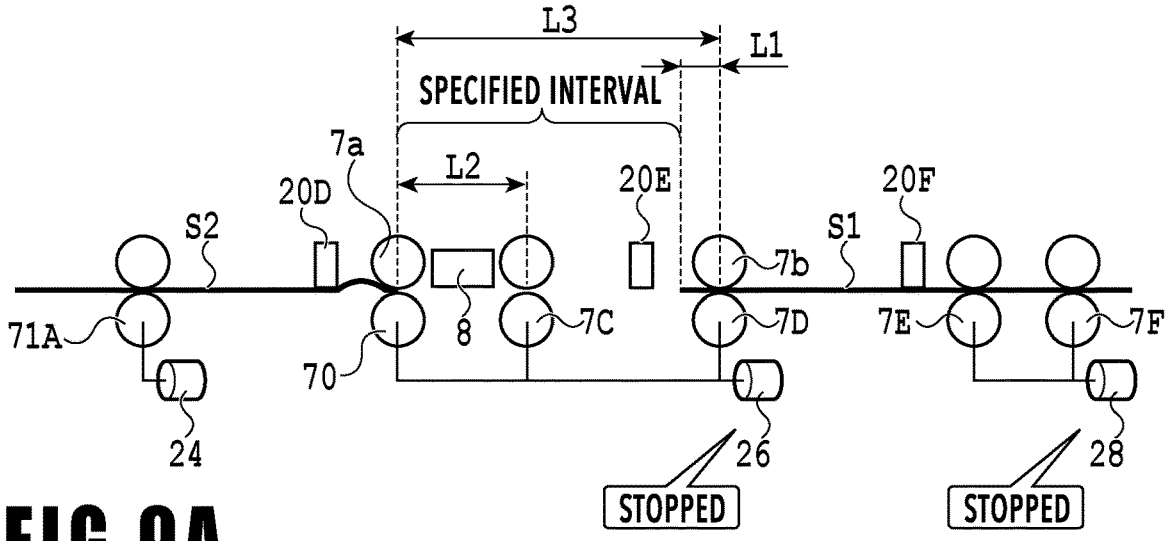
FIGS. 9A, 9B, and 9C are diagrams illustrating conveyance positions that a preceding print medium can take.
Figure 9B:
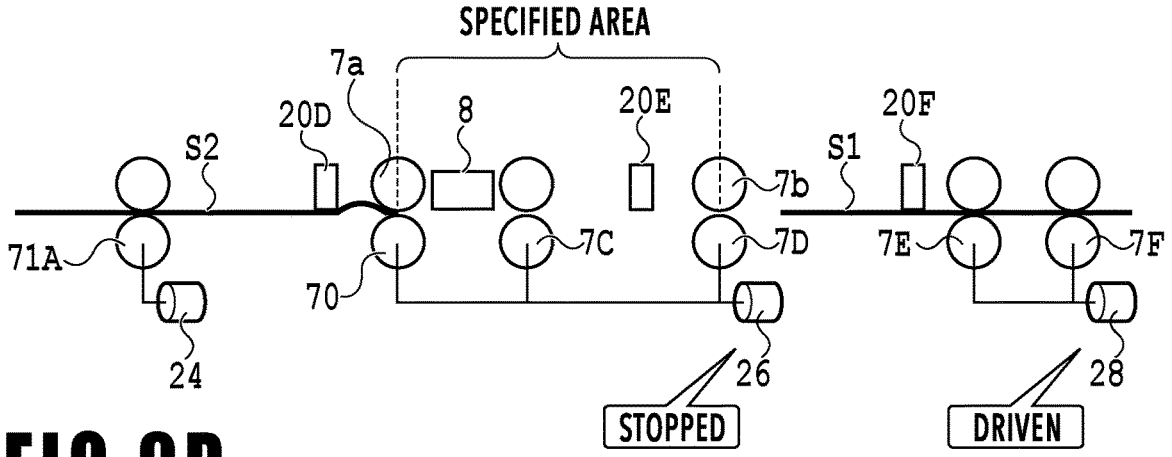
Figure 9C:
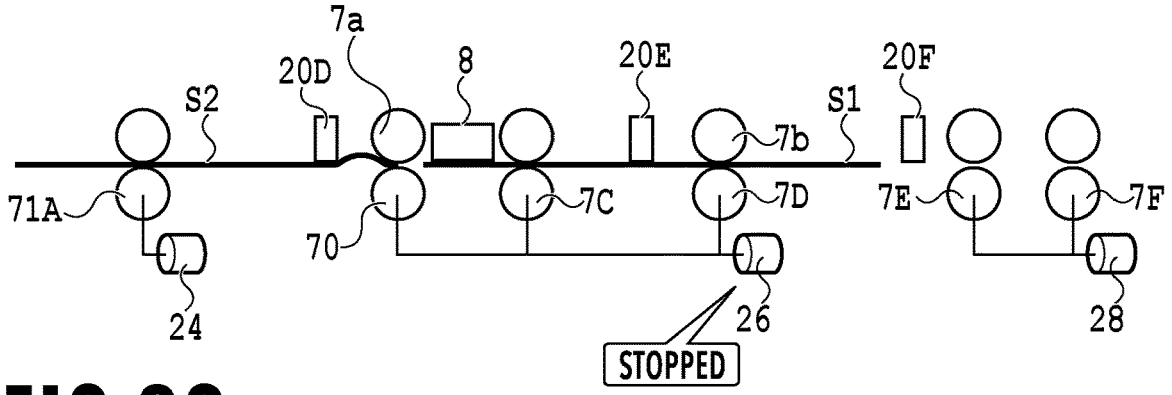

Here, referring to FIGS. 9A, 9B and 9C, description will be provided for the conveyance positions that the preceding print medium S can take when skew correction is performed on the succeeding print media S in continuous printing. FIGS. 9A, 9B, and 9C are schematic diagrams illustrating the conveyance positions that a preceding print medium S1 can take when the skew correction is performed on the succeeding print medium S2. Note that FIGS. 9A, 9B, and 9C illustrate the print media Si and S2 being conveyed continuously in the conveying path for the case where printing is performed on the print media S stored in the first cassette 5A. In the figures, the conveying path is depicted linearly to make it easy to understand. In the following description, "the preceding print medium S1" is simply called "the print medium S1", and "the succeeding print medium S2" is simply called "the print medium S2", as appropriate.

FIG. 9A shows one of the conveyance positions that the print medium S1 (first print medium) can take when the skew correction is performed on the print medium S2 (second print medium). When the skew correction is performed on the print medium S2, driving the conveying motor 26 needs to be stopped to stop driving the main conveying roller 70. However, the conveying motor 26 (first drive unit) drives not only the main conveying roller 70 (the first conveying unit) but also the conveying rollers 7C and 7D. Thus, when the conveying motor 26 is stopped, the conveying rollers 7C and 7D also stop. When the conveying motor 26 is stopped, if printing on the print medium S1 has finished, and the trailing edge of the print medium S1 is passing through the nip portion between the conveying roller 7D and the spur 7*b*, the conveying rollers 7E and 7F, which are located downstream of the conveying roller 7D and through which the print medium S1 is passing (being conveyed), need to be stopped. In other words, to prevent the stopped conveying roller 7D (second conveying unit) from giving damage or the like to the print medium S1, driving the conveying motor 28 (second drive unit) has to be stopped to stop the conveying rollers 7E and 7F (third conveying unit).

After that, the conveying motor 24 drives the first intermediate roller 71A (and the drive rollers upstream thereof) to bring the print medium S2 into contact with the nip portion of the main conveying roller 70, registering the print medium S2 that had skewed. After the skew correction on the print medium S2 finishes, driving the conveying motors 26 and 28 is resumed to discharge the print medium S1 and also perform printing on the print medium S2. In this case, when the skew correction is performed on the print medium S2, printing on the print medium S1 by the print head 8 has already finished. Thus, there is no influence on the print quality of the print medium S1 due to processes along with the skew correction of the print medium S2.

FIG. 9B shows another conveyance position that the print medium S1 can take when the skew correction is performed on the print medium S2. In FIG. 9B, when the main conveying roller 70 is stopped, printing on the print medium S1 has already finished, and the print medium S1 is not nipped by the conveying roller 7D and the spur 7*b*, in other words, the trailing edge of the print medium S1 has already passed through the nip portion between the conveying roller 7D and the spur 7*b*. In this case, even if the conveyance by the conveying rollers 7E and 7F is continued, the conveying roller 7D will not give damage or the like to the print medium S1. Thus, even when the main conveying roller 70 is stopped, the discharging operation of the print medium S1 after printing can be continued while the conveying motor 28 is being driven continuously.

Then, when the main conveying roller 70 has stopped, the print medium S2 is brought into contact with the nip portion of the main conveying roller 70 to perform skew correction on the print medium S2. After this skew correction finishes, driving the conveying motor 26 is resumed to perform printing on the print medium S2. Also in this case, when the skew correction is performed on the print medium S2, printing on the print medium S1 by the print head 8 has already finished. Thus, there is no influence on the print quality of the print medium S1 due to processes along with the skew correction of the print medium S2.

FIG. 9C shows still another conveyance position that the print medium S1 can take when the skew correction is performed on the print medium S2. In FIG. 9C, when the main conveying roller 70 is stopped, the trailing edge of the print medium S1 has already passed through the nip portion of the main conveying roller 70, but the print medium S1 is in the middle of printing by the print head 8. In this case, when driving the conveying motor 26 is stopped, the conveyance of the print medium S1 is stopped, and thus printing on the print medium S1 by the print head 8 needs to be stopped. If the print medium S1 is being conveyed by the conveying rollers 7E and 7F, the conveying motor 28 also needs to be stopped.

Then, when the main conveying roller 70 is stopped, the print medium S2 is brought into contact with the nip portion of the main conveying roller 70 to perform skew correction on the print medium S2. After this skew correction finishes, driving the conveying motor 26 (and the conveying motor 28) is resumed, and the print operation on the print medium S1 by the print head 8 is resumed. In this case, when the skew correction is performed on the print medium S2, printing of the print medium S1 is suspended. For this reason, there might be some influence on the print quality of the print medium S1 due to processes along with the skew correction of the print medium S2.

Here, description will be provided for influence on the print quality due to suspension of printing. When the print medium S is stopped in the conveying path, the print medium S is stopped after the conveyance speed goes down. When the conveyance of the print medium S is resumed, the print medium S is accelerated and then reaches a constant conveyance speed. Then, the printing apparatus 1 performs printing by ejecting ink from the print head 8 of a full line type to the print medium S1 being conveyed. Thus, printing on the print medium S1 is disordered in the areas where a certain conveyance speed is not reached when the conveyance is stopped or resumed, decreasing the print quality.

In view of the above, in the printing apparatus 1, the timing of feeding the print medium S2 is set relative to the print medium S1 such that the skew correction process is performed on the succeeding print medium S2 after printing on the preceding print medium S1 by the print head 8 finishes.

Specifically, in continuous printing, the succeeding print medium S2 is fed when the following two conditions are satisfied. Note that determination of whether these two conditions are satisfied is made by the print controller 202.

A first condition: The interval between the trailing edge of the print medium S1 and the leading edge of the print medium S2 in the conveying path is larger than a specified interval.

A second condition: Specified print conditions on which print operation can be performed are satisfied.

The specified interval in the first condition is a value uniquely determined according to the combination of the size of the print medium S in use and the conveyance speed during printing. When printing is continuously performed on print media S, the shorter the interval between the preceding print medium S1 and the succeeding print medium S2 is, the better throughput is obtained. However, if this interval is too short, when the main conveying roller 70 is stopped for the skew correction of the print medium S2, printing on the print medium S1 has to be stopped as illustrated in FIG. 9C. Thus, the specified interval is set so as to avoid the situation as in FIG. 9C. Specifically, the specified interval is equal to the distance from the leading edge position of the print medium S2 before feeding to the trailing edge of the print medium S1 on which printing by the print head 8 has finished. Note that it is preferable that the distance be shortest to suppress the decrease in throughput. Thus, in this embodiment, the specified interval is set to the shortest one of the above distances. Thus, when the print medium S2 is fed, printing on the print medium S1 by the print head 8 has finished, and the print medium S1 is passing by the conveying roller 7D (conveying roller 7C).

The state where the specified print condition in the second condition is satisfied is one in which information used for printing is generated, the print head 8 is ready for printing, and the conveying mechanism is ready to convey the print medium. Whether the information used for printing has been generated is determined based on, for example, whether print data for printing on the print medium S is generated by the printing apparatus 1 based on a print job inputted from the host apparatus 400. In other words, when it is determined that the print controller 202 has generated print data, it is determined that information used for printing has been generated.

To determine whether the print head 8 is ready for printing, whether the print head 8 is at a specified temperature and whether ink is circulated properly are determined. In addition, whether a recovery process has been properly performed for the print head 8 and whether pre-printing control of the ASIC that controls the print head 8 has finished are also determined for the determination. In summary, when the print controller 202 determines that the print head 8 is at the specified temperature, that the ink is properly circulated, that the recovery process has been properly performed for the print head 8, and that the pre-printing control of the ASIC has finished, it is determined that the print head 8 is ready for printing. Note that the conditions according to which it can be determined that the print head 8 is ready for printing are set depending on the configuration of the printing apparatus 1. Thus, the conditions used for the determination criteria are not limited to those listed above. Those conditions may be changed to other conditions according to which it can be determined that the print head 8 is ready for printing, or other conditions may be added to the above conditions.

Whether the conveying mechanism is ready for conveyance is determined based on whether the cassette 5A or the cassette 5B has been set at the position where print media S stored therein can be fed. Specifically, the printing apparatus 1 has a sensor (not illustrated) that detects whether the cassette 5A or the cassette 5B has been set at the position where print media S stored therein can be fed. Based on the detection result of the sensor, the print controller 202 determines whether conveyance is ready. When it is determined that the cassette 5A or the cassette 5B is set at the position where print media S stored therein can be fed, it is determined that the conveying mechanism is ready for conveyance. Note that the conditions according to which it can be determined that the conveying mechanism is ready for conveyance are set depending on the configuration of the printing apparatus 1. Thus, the conditions used for the determination criteria are not limited to those listed above. Those conditions may be changed to other conditions according to which it can be determined that the cassette 5A or the cassette 5B is set at the position where print media S stored therein can be fed, or other conditions may be added to the above conditions.

Figure 10A:
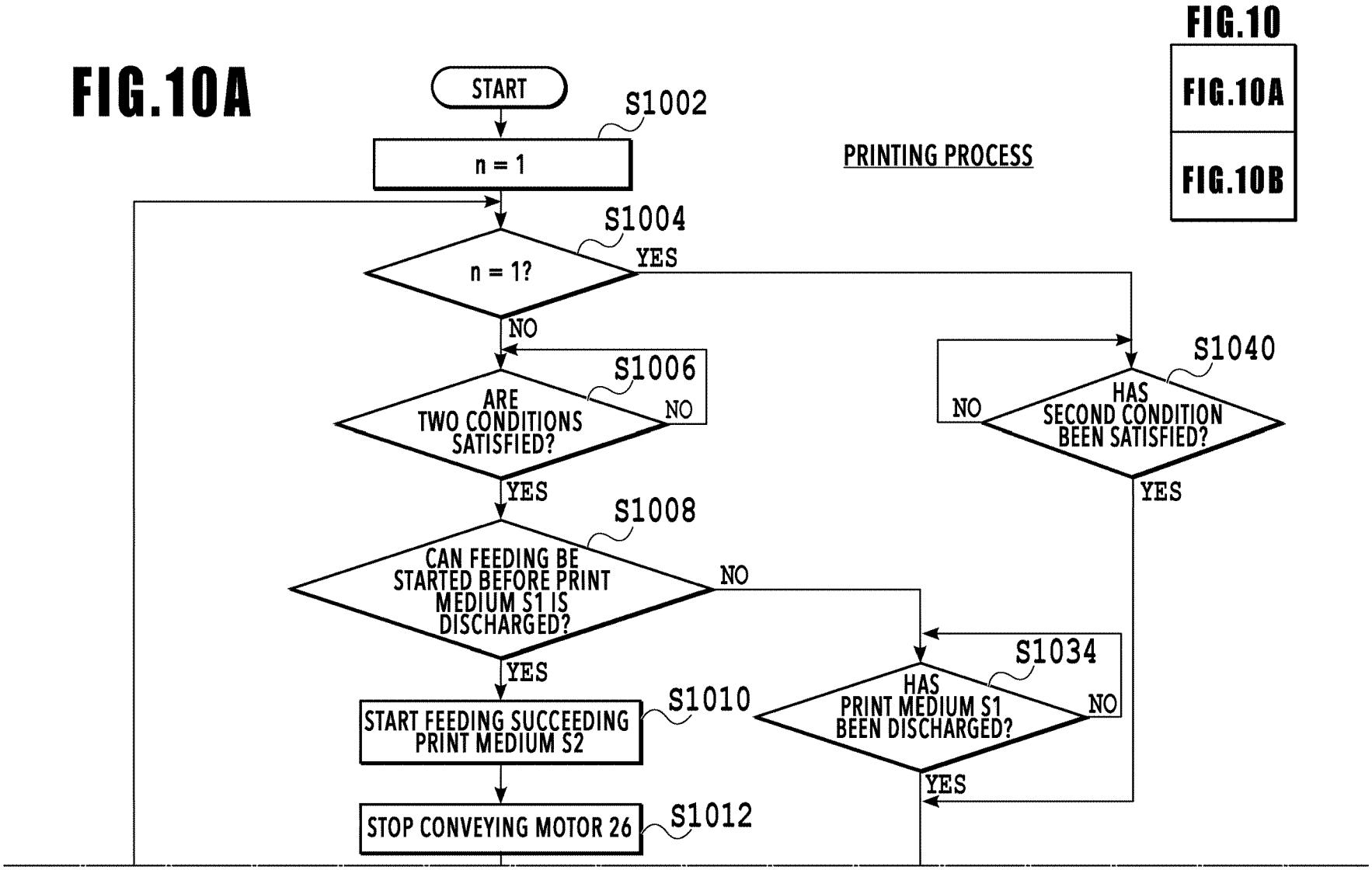
FIGS. 10A and 10B are flowcharts illustrating process routines of a printing process.
Figure 10B:
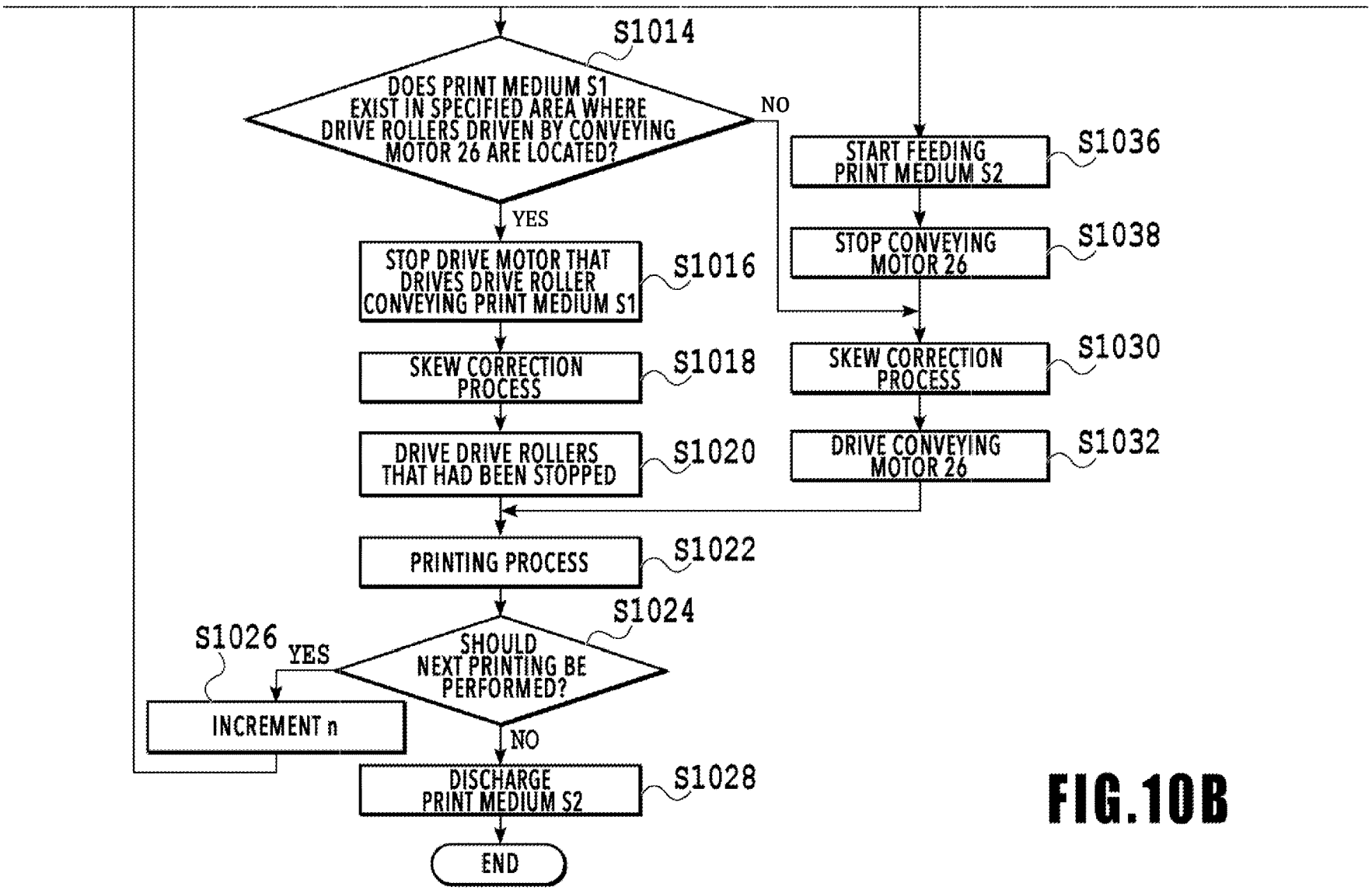

With the configuration described above, when a print job is inputted from the host apparatus 400, a printing process based on the inputted print job starts in the printing apparatus 1. Here, this printing process will be described in detail with reference to FIGS. 10A and 10B. FIGS. 10A and 10 B are flowcharts illustrating detailed process contents of the printing process. A series of processes illustrated in the flowchart of FIGS. 10A and 10B are executed by the print controller 202 deploying program codes stored in the ROM 203 to the RAM 204. Alternatively, part of or all of the functions in the steps in FIGS. 10A and 10B may be implemented using hardware such as an ASIC or an electronic circuit.

When the printing process starts, first, parameter "n" indicating the number of the print media S to be printed by the print job is initialized (S1002). In other words, "n=1" is set at S1002. Next, it is determined whether "n=1" or not (S1004). When it is determined that n=1 at this S1004, it is determined that the current process is for printing on the first print medium S in the print job, and it is determined that there is no preceding print medium S1. When it is determined at S1004 that "n≠1", it is determined that the current process is for printing on the second or a subsequent print medium S in the print job, and it is determined that there is a preceding print medium S1.

When it is determined at S1004 that "n≠1", in other words, that there is a preceding print medium S1, it is determined whether the two conditions have been satisfied (S1006). In other words, the print controller 202 determines at S1006 whether both the first condition and the second condition have been satisfied. At S1006, if it is determined that the two conditions have not been satisfied, the process returns to S1006 again. If it is determined at S1006 that the two conditions have been satisfied, it is determined whether feeding can be performed before the print medium S1 is discharged (S1008). In other words, at S1008, the determination is made, for example, based on the print mode. Specifically, it is determined whether the current print mode is a print mode in which the next printing is performed after the print medium S is discharged. Note that these determination processes are executed by the print controller 202 or the conveyance control unit 207. In other words, in this embodiment, the print controller 202 or the conveyance control unit 207 functions as a determination unit configured to determine whether the print medium S2 is to be fed before the print medium S1 is discharged.

At S1008, if it is determined that feeding may be performed before the print medium S1 is discharged, in other words, if it is determined that the current print mode is not a print mode in which the next printing is performed after the print medium S is discharged, feeding the succeeding print medium S2 is started (S1010). After that, the conveying motor 26 is stopped (S1012). In other words, at S1012, before the print medium S2 reaches the nip portion of the main conveying roller 70, the conveying motor 26 is stopped to stop driving the main conveying roller 70 and the conveying rollers 7C and 7D.

Next, it is determined whether the print medium S1 is positioned in the specified area where the drive rollers driven by the conveying motor 26 are located (S1014). In other words, it is determined at S1014 whether the print medium S1 is positioned in the specified area, in the conveying path, where the main conveying roller 70, the conveying rollers 7C and 7D are located.

Here, if the second condition has already been satisfied when the first condition is satisfied, the interval between the trailing edge of the print medium S1 and the leading edge of the print medium S2 is equal to the specified interval. If the second condition is satisfied within a specified time after the first condition is satisfied, the interval between the trailing edge of the print medium S1 and the leading edge of the print medium S2 is equal to the distance obtained by adding the length corresponding to the specified time to the specified interval.

The specified time is set based on the conveyance speed Vs of the print medium S and distance L1 from the trailing edge of the print medium S1 away from the leading edge of the print medium S2 by the specified interval to the nip portion between the conveying roller 7D and the spur 7*b* (see FIG. 9A). In other words, the specified time is set to a time not exceeding the time taken for the trailing edge of the print medium S1 being conveyed at conveyance speed Vs to move from the position at the specified interval from the leading edge of the print medium S2 to the nip portion between the conveying roller 7D and the spur 7*b*.

Thus, in the case where the second condition is satisfied within the specified time after the first condition is satisfied, it is determined that the trailing edge of the print medium S1 is passing through the nip portion between the conveying roller 7D and the spur 7*b* and that the print medium S1 is positioned in the specified area, as illustrated in FIG. 9A. Note that at this time, printing on the print medium S1 has already finished.

In the case where the second condition is not satisfied within the specified time after the first condition is satisfied, the print medium S1 continues to be conveyed until the second condition is satisfied after the specified time has passed, and thus, the interval between the trailing edge of the print medium S1 and the leading edge of the print medium S2 exceeds the specified interval to a large extent. At this time, since the specified time is set as described above, the trailing edge of the print medium S1 has already passed by the nip portion between the conveying roller 7D and the spur 7*b*. In other words, in this case, it is determined that the print medium S1 is positioned downstream of the specified area, in other words, outside the specified area, as illustrated in FIG. 9B.

If it is determined at S1014 that the print medium S1 is positioned in the specified area where the main conveying roller 70 and the conveying rollers 7C and 7D are located, driving the drive motor that drives the drive rollers (such as the conveying rollers 7E and 7F) that are conveying the print medium S1 is stopped (S1016). Note that the process at S1016 is not limited to stopping driving the drive rollers that are conveying the print medium S1; for example, all the drive rollers located downstream of the conveying roller 7D may be stopped.

After that, the skew correction process is performed on the print medium S2 (S1018). After the skew correction process finishes, the drive rollers that had been stopped are driven (S1020). In the skew correction process at S1018, the skew correction of the print medium S2 is performed by bringing the leading edge of the print medium S2 into contact with the nip portion of the main conveying roller 70 not in operation. At S1020, driving of the conveying motor 26 and the drive motors that were stopped at S1016 is resumed.

Then, the printing process is performed on the print medium S2 (S1022). In other words, at S1022, printing is performed on the print medium S2 on which the skew correction has been performed. At this time, since the drive rollers to convey the print medium S1 are being driven by the step at S1020, the print medium S1 is conveyed toward the discharging tray 13. After printing on the print medium S1 finishes, it is determined whether printing is to be performed on the next print medium S (S1024). When it is determined at S1024 that printing is to be performed on the next print medium S, parameter "n" is incremented (step S1026), the process returns to S1004, and the subsequent processes are performed. At this time, what had been referred to as the succeeding print medium S2 is now the preceding print medium S1. If it determined at S1024 that printing is not to be performed on the next print medium S, the print medium S2 is discharged to the discharging tray 13 (S1028), and this printing process ends.

At S1014, if it is determined that the print medium S1 is not positioned in the specified area where the main conveying roller 70 and the conveying rollers 7C and 7D are located, the skew correction process is performed on the print medium S2 while the print medium S1 is being conveyed (S1030). The skew correction process in S1030 is the same process as in S1018. When this skew correction process finishes, the conveying motor 26 is driven (S1032), and driving the main conveying roller 70 and the conveying rollers 7C and 7D is resumed to convey the print medium S2. Then, the process advances to S1020, and the subsequent processes are performed.

Further, at S1008, if it is determined that feeding cannot be performed before the print medium S1 is discharged, in other words, if it is determined that the current print mode is one in which the next printing is performed after the print medium S is discharged, it is determined whether the print medium S1 has been discharged (S1034). Specifically, at S1034, for example, it is determined that the detection member 20G has detected the trailing edge of the print medium S1. If it is determined at S1034 that the print medium S1 has not been discharged, in other words, if it is determined that the detection member 20G has not detected the trailing edge of the print medium S1, the process returns to S1034 again. If it is determined at S1034 that the print medium S1 has been discharged, in other words, if it is determined that the detection member 20G has detected the trailing edge of the print medium S1, feeding the print medium S2 is started (S1036), and the conveying motor 26 is stopped (S1038). The process contents in S1036 and S1038 are the same as those in S1010 and S1012, respectively. After that, the process advances to S1030, and the subsequent processes are performed.

At S1004, if it is determined that "n=1", in other words, that a preceding print medium S1 does not exist, it is determined whether the second condition has been satisfied (S1040). If it is determined that the second condition has not been satisfied, the process returns to S1040 again. If it is determined at S1040 that the second condition has been satisfied, the process advances to S1036, and the subsequent processes are performed.

As has been described above, in the printing apparatus 1, the conveying motor 26 drives the main conveying roller 70 with which the leading edge of the print medium S is brought into contact in skew correction as well as the conveying rollers 7C and 7D disposed opposite of the printing position of the print head 8 from the main conveying roller 70. Then, in the case where the conveying roller 7D together with the spur 7*b* nips the preceding print medium S1 in continuous printing, the conveying rollers 7E and 7F located downstream of the conveying roller 7D and convey the print medium S1 are stopped to stop the conveyance of the print medium S1. On the other hand, in the case where the conveying roller 7D together with the spur 7*b* does not nip the preceding print medium S1, driving the conveying rollers 7E and 7F is kept to continue to convey the print medium S1.

This makes it possible to downsize the printing apparatus 1. This also reduces the number of drive motors, making the structure simple, and makes it possible to reduce the production cost. Further, since this is not a configuration in which printing on the print medium S is suspended when the main conveying roller 70 is stopped, it is less likely to cause degradation in the print quality. Furthermore, since the printed print medium S1 is stopped or conveyed continuously depending on the position thereof when the skew correction is performed on the print medium S2, decrease in the throughput is suppressed.

In addition, when the first condition that the interval between the leading edge of the succeeding print medium S2 and the trailing edge of the preceding print medium S1 is a specified interval and the second condition that specified print conditions are satisfied, are satisfied, driving the conveying motor 26 that drives the main conveying roller 70 is stopped. This specified interval is equal to the distance from the leading edge of the print medium S2 before feeding to the trailing edge of the print medium S1 on which printing by the print head 8 has been finished, and the distance is set to the shortest one.

Thus, if the two conditions are approximately satisfied, the print medium S2 is conveyed at an interval close to the specified interval. At this time, although the conveyance of the print medium S1 is stopped when the skew correction is performed on the print medium S2, decrease in the throughput is suppressed because the interval between the print media S1 and S2 is small. In the case where the second condition is satisfied after the specified time has passed since the first condition was satisfied, the print medium S2 is conveyed at an interval exceeding the specified interval to a large extent.

In this case, the interval between the print media S1 and S2 is long, and the time after printing is performed on the print medium S1 until printing is performed on the print medium S2 is long, as compared to the above case. However, since the conveyance of the print medium S1 continues when the skew correction is performed on the print medium S2, a significant decrease in the throughput can be avoided.

Note that the above embodiment may be modified to the following (1) to (4).

(1) Printing apparatuses to which the present invention is applicable are not limited only to inkjet printing apparatuses, but the present invention is applicable to printing apparatuses that perform printing on print media S by various methods. Printing apparatuses to which the present invention is applicable are not limited to what are called full line inkjet printing apparatuses as in the above embodiment, but the present invention is also applicable, for example, to serial inkjet printing apparatuses.

(2) The present invention may be applied to conveying apparatuses that convey print media S using the print controller 202, the conveyance control unit 207, and the above conveying mechanism. In addition, the present invention is applicable not only to printing apparatuses for print media but also, for example, to various processing apparatuses that perform predetermined processes for print media, such as image scanning apparatuses that scan images printed on print media.

(3) The arrangement positions of the detection members 20, which drive rollers are provided with the encoders 21, and the correspondence relationship between the drive rollers the motors are not limited to those in the above embodiment, and they are modified as appropriate depending on the shape of the conveying path and other factors.

(4) Although in the above embodiment, the distance between the print medium S1 on which printing has been finished and the print medium S2 before feeding is equal to the specified interval, the present invention is not limited to this setting. Specifically, the specified interval may be, for example, longer than the interval between the main conveying roller 70 and the conveying roller 7C (fourth conveying unit). In other words, the specified interval is longer than the distance L2 from the nip portion of the main conveying roller 70 to the nip portion between the conveying roller 7C and the spur 7*b*. Alternatively, in a case, for example, where the distance from the first feeding roller 6A-1 to the main conveying roller 70 is sufficiently longer than the distance from the main conveying roller 70 to the conveying roller 7D in the conveying path, the specified interval may be longer than the interval between the main conveying roller 70 and the conveying roller 7D. In other words, the specified interval is longer than the distance L3 from the nip portion of the main conveying roller 70 to the nip portion between the conveying roller 7D and the spur 7*b*. Note that the upper limit of the specified interval in these cases is set as appropriate considering the throughput and other factors.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)TM), a flash memory device, a memory card, and the like.

Although in the above embodiment, feeding the print medium S2 is started after the main conveying roller 70 is stopped, the present invention is not limited to this operation. Stopping the main conveying roller 70 and feeding the print medium S2 may be started at the same time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-065555, filed Mar. 29, 2018, which is hereby incorporated by reference herein in its entirety.

What is claimed is:

1. A printing apparatus comprising:

a printing unit configured to perform printing on a print medium;

a first conveying unit disposed upstream of the printing unit with respect to a conveyance direction of the print medium, the first conveying unit being configured to convey the print medium to a position facing the printing unit and stop to perform skew correction on the print medium;

a second conveying unit configured to be disposed downstream of the printing unit in the conveyance direction and convey the print medium;

a third conveying unit configured to be disposed downstream of the second conveying unit in the conveyance direction and convey the print medium;

a first drive unit configured to drive the first conveying unit and the second conveying unit;

a second drive unit configured to drive the third conveying unit; and a drive control unit configured to perform control such that when skew correction is performed on a second print medium on which printing is to be performed subsequent to a first print medium, if the first print medium is not being nipped by the second conveying unit, the second drive unit continues to be driven and the first drive unit is stopped, and if the first print medium is being nipped by the second conveying unit, the first drive unit and the second drive unit are stopped.

2. The printing apparatus according to claim 1, wherein in a case where a first condition in which an interval between a trailing edge of the first print medium and a leading edge of the second print medium is longer than a specified interval is satisfied, the drive control unit stops the first drive unit.

3. The printing apparatus according to claim 2, wherein in a case where a second condition in which information to be used for printing is generated, the printing unit is ready for printing, and the print medium is ready to be conveyed is satisfied, the drive control unit stops the first drive unit.

4. The printing apparatus according to claim 3, further comprising:

a feeding unit configured to be disposed upstream of the first conveying unit with respect to the conveyance direction and feed the print medium to the first conveying unit; and a third drive unit configured to drive the feeding unit, wherein the specified interval is a distance from the leading edge of the second print medium before the second print medium is fed by the feeding unit, to the trailing edge of the first print medium on which printing has been performed by the printing unit.

5. The printing apparatus according to claim 4, further comprising:

a determination unit configured to determine whether the second print medium is to be fed before the first print medium is discharged, wherein in a case where the first condition and the second condition are satisfied, and the determination unit determines that the second print medium is to be fed before the first print medium is discharged, the drive control unit starts feeding of the second print medium before the first print medium is discharged, and in a case where the first condition and the second condition are satisfied, and the determination unit determines that the second print medium is not to be fed before the first print medium is discharged, the drive control unit starts feeding of the second print medium after the first print medium has been discharged.

6. The printing apparatus according to claim 2, wherein the specified interval is longer than an interval between a downstream end of the first conveying unit and an upstream end of the second conveying unit.

7. The printing apparatus according to claim 2, wherein the specified interval is longer than an interval between the first conveying unit and a fourth conveying unit configured to be driven by the first drive unit and located between the printing unit and the second conveying unit.

8. The printing apparatus according to claim 3, wherein in a case where the second condition has already been satisfied when the first condition is satisfied, and in a case where the second condition is satisfied within a specified time after the first condition is satisfied, the drive control unit determines that the first print medium is being conveyed by the second conveying unit when the first conveying unit is stopped, and stops driving the second drive unit, and in a case where the second condition is satisfied after the specified time has passed since the first condition was satisfied, the drive control unit determines that the first print medium is not being conveyed by the second conveying unit when the first conveying unit is stopped, and continues driving the second drive unit.

9. The printing apparatus according to claim 1, further comprising:

a feeding unit configured to be disposed upstream of the first conveying unit with respect to the conveyance direction and feed the print medium to the first conveying unit, wherein skew correction is performed by bringing the print medium into contact with the first conveying unit not in operation while the feeding unit is being driven.

10. The printing apparatus according to claim 1, wherein the printing unit is a print head that ejects ink to print an image.

11. The printing apparatus according to claim 10, wherein the print head is a line head having multiple ejecting ports configured to eject ink and arrayed by a length corresponding to a width of the print medium.

12. A method of controlling a printing apparatus including:

a printing unit configured to perform printing on a print medium;

a first conveying unit disposed upstream of the printing unit in a conveyance direction of the print medium, the first conveying unit being configured to convey the print medium to a position facing the printing unit and stop to perform skew correction on the print medium;

a second conveying unit configured to be disposed downstream of the printing unit in the conveyance direction and be driven together with the first conveying unit by a first drive unit; and a third conveying unit configured to be disposed downstream of the second conveying unit in the conveyance direction and be driven by a second drive unit diffrent from the first drive unit;

the method comprising:

a drive controlling step of performing control such that when skew correction is performed on a second print medium on which printing is to be performed subsequent to a first print medium, if the first print medium is not being nipped by the second conveying unit, the second drive unit continues to be driven and the first drive unit is stopped, and if the first print medium is being nipped by the second conveying unit, the first drive unit and the second drive unit are stopped.

13. The method of controlling a printing apparatus according to claim 12, wherein in the drive controlling step, in a case where a first condition in which an interval between a trailing edge of the first print medium and a leading edge of the second print medium is longer than a specified interval is satisfied, the first drive unit is stopped.

14. The method of controlling a printing apparatus according to claim 13, wherein in the drive controlling step, in a case where a second condition in which information to be used for printing is generated, the printing unit is ready for printing, and the print medium is ready to be conveyed is satisfied, the first drive unit is stopped.

15. The method of controlling a printing apparatus according to claim 14, wherein the printing apparatus further includes a feeding unit configured to feed the print medium to the first conveying unit and a third drive unit configured to drive the feeding unit, and the specified interval is a distance from the leading edge of the second print medium, before the second print medium is fed by the feeding unit, to the trailing edge of the first print medium on which printing has been performed by the printing unit.

16. The method of controlling a printing apparatus according to claim 15, wherein in the drive controlling step, in a case where the first condition and the second condition are satisfied, and it is determined that the second print medium is to be fed before the first print medium is discharged, feeding of the second print medium is started before the first print medium is discharged, and in a case where the first condition and the second condition are satisfied, and it is determined that the second print medium is not to be fed before the first print medium is discharged, feeding of the second print medium is started after the first print medium has been discharged.

17. The method of controlling a printing apparatus according to claim 13, wherein the specified interval is longer than an interval between a downstream end of the first conveying unit and an upstream end of the second conveying unit.

18. The method of controlling a printing apparatus according to claim 13, wherein the specified interval is longer than an interval between the first conveying unit and a fourth conveying unit configured to be driven by the first drive unit and located between the printing unit and the second conveying unit.

19. The method of controlling a printing apparatus according to claim 14, wherein in the drive controlling step, in a case where the second condition has already been satisfied when the first condition is satisfied, and in a case where the second condition is satisfied within a specified time after the first condition is satisfied, it is determined that the first print medium is being conveyed by the second conveying unit when the first conveying unit is stopped, and driving of the second drive unit is stopped, and in a case where the second condition is satisfied after the specified time has passed since the first condition was satisfied, it is determined that the first print medium is not being conveyed by the second conveying unit when the first conveying unit is stopped, and driving of the second drive unit is continued.

20. A non-transitory computer readable storage medium storing a program for causing a computer to perform a method of controlling a printing apparatus including:

a printing unit configured to perform printing on a print medium;

a first conveying unit disposed upstream of the printing unit with respect to a conveyance direction of the print medium, the first conveying unit being configured to convey the print medium to a position facing the printing unit and stop to perform skew correction on the print medium;

a second conveying unit configured to be disposed downstream of the printing unit in the conveyance direction and be driven together with the first conveying unit by a first drive unit; and a third conveying unit configured to be disposed downstream of the second conveying unit in the conveyance direction and be driven by a second drive unit different from the first drive unit, the method comprising:

a drive controlling step of causing a computer included in the printing apparatus to perform control such that when skew correction is performed on a second print medium on which printing is to be performed subsequent to a first print medium, if the first print medium is not being nipped by the second conveying unit, the second drive unit continues to be driven and the first drive unit is stopped, and if the first print medium is being nipped by the second conveying unit, the second drive unit and the first drive unit are stopped.

* * * * *